United States Patent [19]

Forrester

[11] Patent Number: 4,670,909

[45] Date of Patent: Jun. 9, 1987

[54] POCKET GLOVE

[76] Inventor: Lynne Forrester, 736 Guthrie, Des Moines, Iowa 50316

[21] Appl. No.: 714,936

[22] Filed: Mar. 22, 1985

[51] Int. Cl.[4] ..... A41D 19/00

[52] U.S. Cl. ..... 2/160

[58] Field of Search ..... 2/160, 161 R, 159, 158; 206/37, 37.1, 37.2, 37.3, 37.4, 37.5, 37.6, 37.7, 37.8

[56] References Cited

U.S. PATENT DOCUMENTS

| | | | |
|---|---|---|---|
| 1,102,379 | 7/1914 | Zoller | 206/37.2 |
| 1,154,122 | 9/1915 | Kovesy | 2/160 |
| 1,548,155 | 8/1925 | Milbrad | 206/37.1 |
| 1,970,081 | 8/1934 | Eisendrath | 2/158 |
| 2,125,354 | 8/1938 | Meier | 206/37 |
| 2,831,196 | 4/1958 | Scheiber | 2/159 |
| 3,189,073 | 6/1965 | Todd | 2/159 |
| 4,408,358 | 10/1983 | Swan | 2/161 A |

FOREIGN PATENT DOCUMENTS

| | | | |
|---|---|---|---|
| 665178 | 9/1938 | Fed. Rep. of Germany | 2/160 |
| 795581 | 3/1936 | France | 2/160 |
| 348737 | of 1937 | Italy | 2/160 |

OTHER PUBLICATIONS

Woman's World-Dec. 1984 issue-photocopy of Change Gloves.

*Primary Examiner*—Louis K. Rimrodt
*Assistant Examiner*—Joseph S. Machuga
*Attorney, Agent, or Firm*—Henderson & Sturm

[57] ABSTRACT

An apparatus for covering a human hand having a front flexible panel for covering the palm of the hand, a back flexible panel for covering the back of the hand, flexible structures for covering the fingers and thumb of the hand and intermediate structures for interconnecting the front and back panels. A wrist covering structure is also connected to the front and back panels for covering the wrist of the hand and a pocket is formed on the back flexible panel. The pocket has an access opening thereon and a zipper closure thereon.

4 Claims, 8 Drawing Figures

POCKET GLOVE

TECHNICAL FIELD

The present invention relates generally to gloves or mittens and more particularly to a glove or mitten having a pocket therein for holding coins, keys or the like.

BACKGROUND ART

Various holders have been utilized over the years to hold coins, keys or other small objects that people need to carry from place to place. Coin purses and key holders are commonly used for this purpose. Such a purse or holder is typically stored in a pocket or perhaps in a larger purse or the like. It is consequently easy to misplace or lose a separate coin purse or key holder.

One proposed solution to the aforementioned problem has been to "attach" a coin purse like structure to a wrist portion of a glove with the opening of such coin purse like structure being disposed substantially parallel to the axis of bending of the wrist. A problem with such structure is that the opening is difficult to open when the glove is on a hand, especially since a properly fitted glove is tight on the wrist portion to seal out air from the hand. Flexing or pivoting of the hand having this prior art structure thereon will only exacerbate this access problem.

Since it can be a cold and difficult process to locate and obtain access to keys or coins under winter conditions, there is a need for solutions to the aforementioned problems.

DISCLOSURE OF THE INVENTION

The present invention relates to an apparatus for covering a human hand having a front flexible panel for covering the palm of the hand, a back flexible panel for covering the back of the hand, flexible structures for covering the fingers and thumb of the hand and intermediate structures for interconnecting the front and back panels. A wrist covering structure is also connected to the front and back panels for covering the wrist of the hand. A pocket is formed on the back flexible panel and the pocket has an access opening in certain locations thereon with a closure attached thereto.

An object of the present invention is to provide an improved glove or mitten having a storage compartment formed thereon.

Another object of the present invention is to provide a glove or mitten with a storage compartment on the back of the hand for readily facilitating opening or closing of such compartment by movement of the hand itself.

A further object of the invention is to provide a glove or mitten of the aforementioned type which has a security strap around the wrist portion thereof for preventing loss of the mitten or glove and the contents of the storage compartment.

A further object of the present invention is to provide a storage compartment for keys and a mechanism for preventing loss of such keys while still permitting the keys to be utilized easily.

Other objects, advantages, and novel features of the present invention will become apparent from the following detailed description of the invention when considered in conjunction with the accompanying drawings.

BEST MODES FOR CARRYING OUT THE INVENTION

Figure 1:
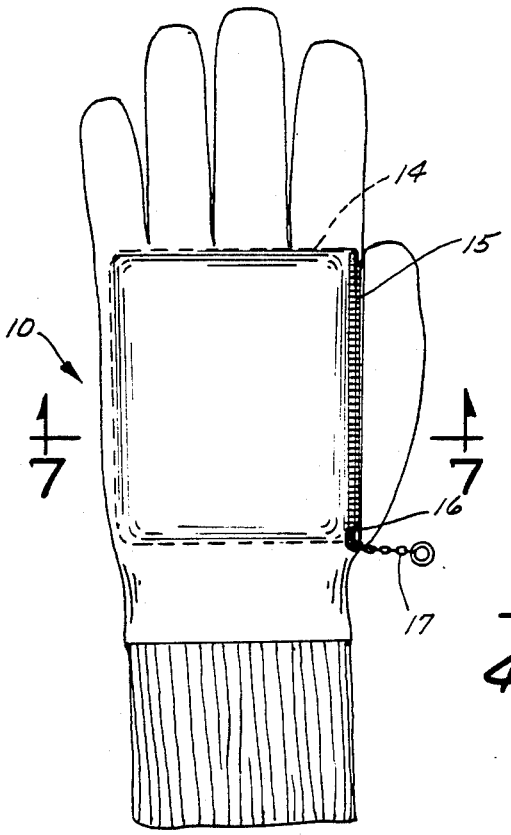
FIG. 1 shows a view of the back side of a preferred embodiment of the present invention.
Figure 2:
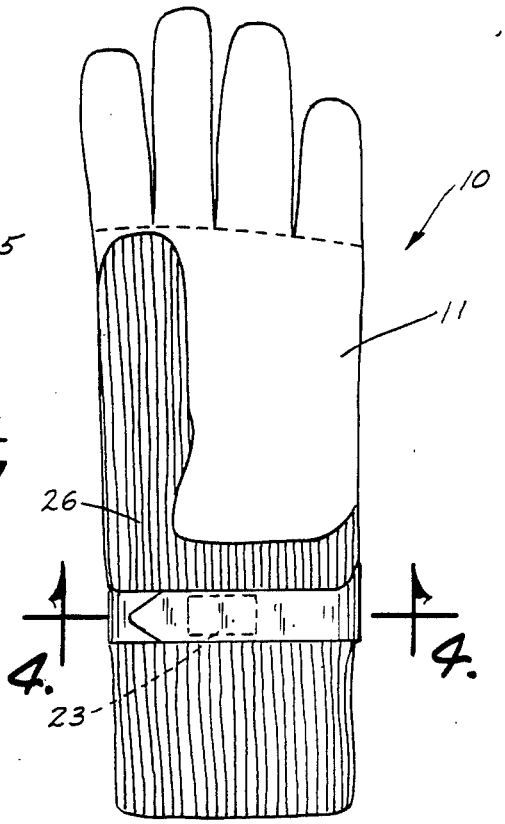
FIG. 2 shows a view of the front side of a preferred embodiment of the present invention, but with the thumb portion thereof moved somewhat from the FIG. 1 view.

Referring now to the drawings wherein like reference numerals designate identical or corresponding parts throughout the several views, FIG. 1 shows a glove (10) constructed in accordance with the present invention. The glove (10) has a back panel (12) and a front panel (11). These front and back panels (11) and (12) extend upwardly, and extensions thereon secured to the front (11) and back 12 panels form and the fingers and thumb of a glove (10).

Figure 3:
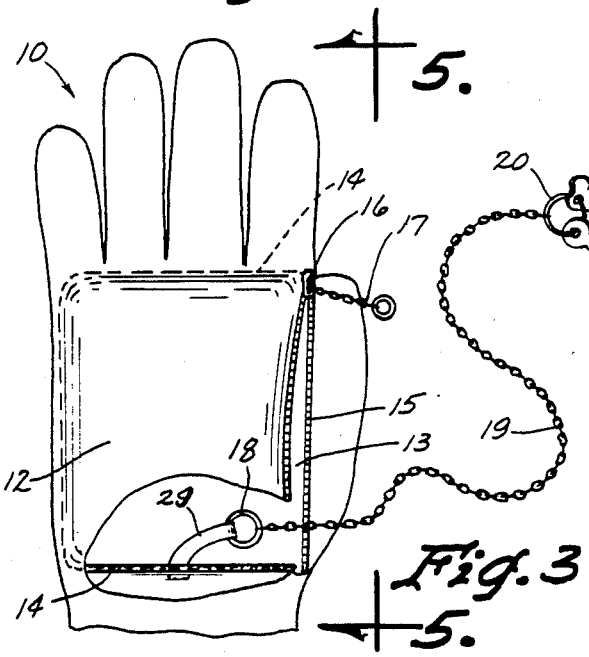
FIG. 3 is a view of a preferred embodiment of the invention similar to FIG. 1, but showing a portion of the storage compartment cut away and the storage compartment being open to show a key chain device which can be stored in the storage compartment but is shown extended outwardly for use.

Referring to FIG. 3, it is noted that a pocket or storage compartment (13) is formed by having a an intermediate layer of material (27) adjacent to the outer part of a hand within the glove (10), an outer layer of material (12) which forms the outermost part of the glove and these layers are sewed together at seam (14) to form such storage compartment. A zipper (15) extends along one side edge of the glove (10), as can readily be seen in FIGS. 1 and 3. This zipper (15) has an opening and/or closing mechanism (16) with a chain and loop structure (17) attached thereto for facilitating the opening and closing of the zipper (15). A looped strap (29) secures a metal ring (18) to the interior seam (14) of the storage compartment (13). Looking at FIG. 3 it is noted that a chain (19) is connected to the metal loop (18) and a key ring (20) is connected to the other end of the chain (19). Keys (21) are connected to the key chain (20) in a conventional fashion.

Figure 4:
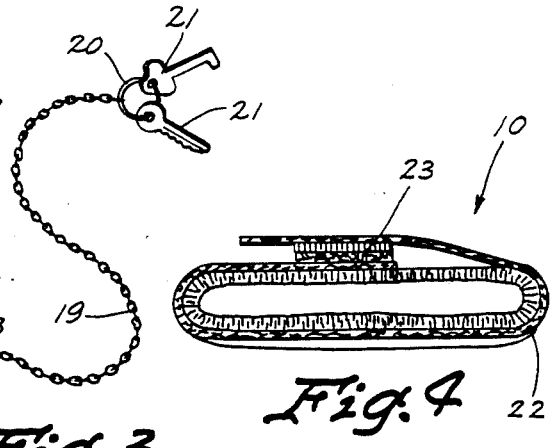
FIG. 4 is a cross sectional view taken along line 4—4 of FIG. 2.

Referring to FIG. 4, it is noted that a non-stretchable material such as leather (22) forms a strap around the wrist of the glove and has Velcro fasteners (23) disposed thereon for securing the glove (10) to the wrist of a person. Once the Velcro fasteners (23) are fastened down, not only is a very good seal formed to prevent outside air from entering the glove, but this makes it difficult, if not impossible, for someone to snatch the glove having valuables within the storage compartment (13) by someone predisposed to snatch purses or other valuables from people in public places.

Figure 5:
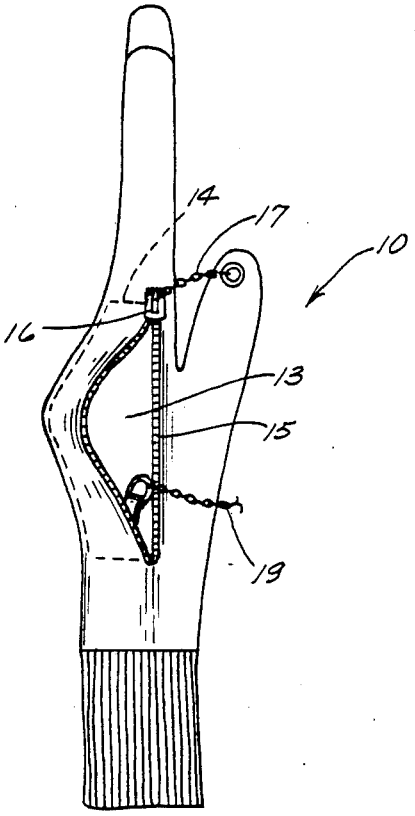
FIG. 5 is a view taken along line 5—5 of FIG. 3 and showing how the compartment will automatically open when the fingers of the hand are extended out straight when the zipper is unzipped.
Figure 7:
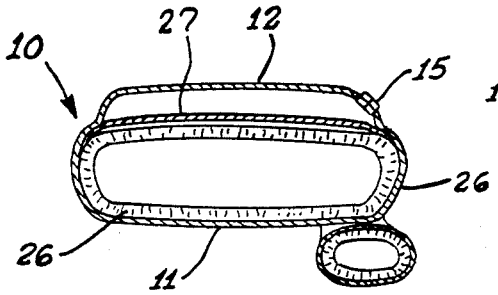
FIG. 7 is a cross-sectional view of the preferred embodiment of the invention taken through line 7—7 of FIG. 1; and, FIG. 8 is a cross-sectional view of the alternate embodiment of the invention taken through line 8—8 of FIG. 6.
Figure 8:
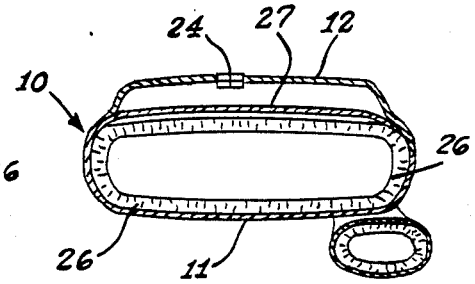

The zipper (15) is positioned along the edge of the glove in the orientation shown in FIGS. 1, 3 and 5, wherein the opening for compartment (13) is formed between the front and back panels (11) and (12). This placement of the opening for compartment (13) allows the opening to be opened easily by merely opening the zipper (15) and straightening the fingers of the hand to cause the glove to be in the position shown in FIG. 5. Since the back panel (12) has a very slightly more and stiffer material than the underside of the compartment (13), such compartment will open automatically to the position shown in FIG. 5, thereby providing ready access to whatever is in the compartment (13) or for placing objects such as coins into the compartment (13).

Additionally, ready access can be had to the keys (21) within the compartment (13) without fear of losing the keys (21). The other hand can be utilized to grasp the keys (21) and, because of the sufficient length of the chain (19), the keys (21) can be utilized while the glove (10) is on the left hand of the user. Then, after the keys (21) have been utilized, such as for opening a house or apartment door, they can then readily be reinserted into the compartment (13), along with the key chain (20) and chain (19), and the zipper (15) closed to store the keys (21) and whatever other things are desired to be stored in the compartment (13).

Figure 6:
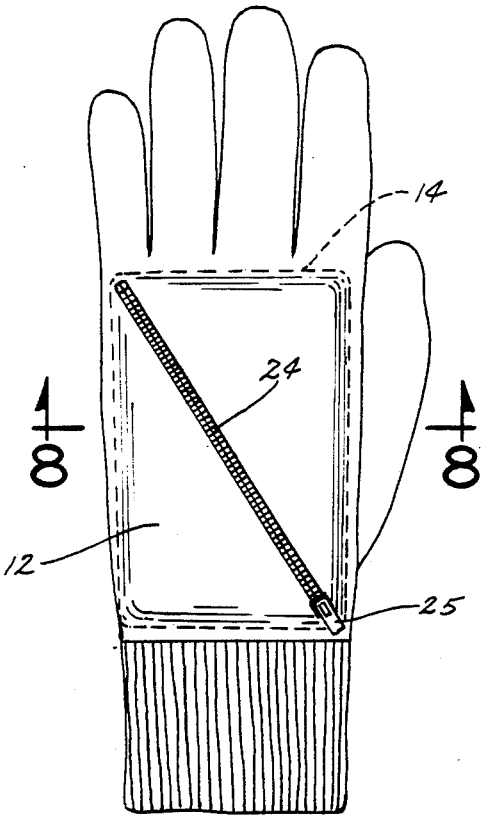
FIG. 6 is a view of the back of another embodiment of the present invention.

Referring now to the alternate embodiment invention shown in FIG. 6, it is noted that a zipper (24) is sewn in to the back panel (12) diagonally across the back panel (12) where the back of the hand would be, but not extending onto the wrist portion of the glove. A compartment like the compartment (13) shown in FIG. 3 of the preferred embodiment, has an access thereto by the zipper (24) having a conventional member (25) attached thereto which can be grasped with the other hand and moved between open and closed positions. As in the embodiment of FIGS. 1–5, it is noted that when the zipper (24) is open and the fingers of the hand within the glove as shown in FIG. 5 are straightened, the access opening formed by the zipper (24) will automatically open to provide access thereto.

Obviously many modifications and variations of the present invention are possible in light of the above teachings. For example the Velcro closure (23) could be a buckle or any other means for securing the wrist portion of the glove tightly to the wrist of the person and be adjustable in that respect. The glove can be made of different types of material and can, of course, be a mitten instead. It is therefore to be understood that, within the scope of the appended claims, the invention may be practiced otherwise than as specifically described.

I claim:

1. An apparatus for covering a human hand comprising:

a front flexible panel means for covering the palm of a hand;

a back flexible panel means for covering the back of a hand;

flexible digit means connected at the base thereof to said front and back panel means for covering the fingers including the index finger and thumb of the hand;

means for interconnecting the front and back panel means;

means connected to said front and back flexible panel for covering a wrist connected to the hand;

means for forming a pocket on said back flexible panel means;

means disposed on said pocket means for providing access to the interior of said pocket means from the outside thereof, said pocket means having a top flexible layer and a bottom flexible layer;

means for selectively opening or closing said access means to prevent objects disposed in said pocket means from falling out, said closing means comprising a zipper, said zipper being connected on one side to said pocket means and on the other side thereof to said interconnecting means, said zipper being disposed directly adjacent to the thumb covering portion of the digit covering means adjacent to said back flexible panel and spaced from said front flexible panel and extending generally in alignment with the thumbward side of an index finger covering portion of the digit covering means, said zipper extending from the base of the thumb portion of the flexible digit means to the base of the index finger portion of the flexible digit means; and wherein the top flexible layer of said pocket means has material of slightly greater length from front to back than the bottom layer thereof whereby when the fingers of the hand are straightened, the pocket will open if the zipper has been unzipped.

2. The apparatus of claim 1 including security means for selectively holding a portion of said front and back panel means tightly around a person's wrist.

3. The apparatus of claim 1 including means attached to the interior of said pocket means for attaching a key thereto, said key attaching means including flexible means interconnecting the interior of the pocket means to the key which is long enough to permit the key to be used to unlock a lock with the other hand.

4. An apparatus for covering a human hand comprising:

a front flexible panel means for covering the palm of a hand;

a back flexible panel means for covering the back of a hand;

flexible digit means connected to said front and back panel means for covering the fingers and thumb of the hand;

means for interconnecting the front and back panel means;

means connected to said front and back flexible panel for covering a wrist connected to the hand;

means for forming a pocket on said back flexible panel means;

means disposed on said pocket means for providing access to the interior of the pocket means from the outside thereof, said pocket means having a top flexible layer and a bottom flexible layer;

closing means for selectively opening or closing said access means to prevent objects disposed in said pocket means from falling out;

said closing means comprising a zipper, said zipper extending diagonally across a back portion of the pocket means; and wherein the top flexible panel of said pocket means having material of slightly greater length from front to back than the bottom layer whereby when the fingers of the hand are straightened, the pocket will open if the zipper is unzipped.

* * * * *